US009868127B2

(12) United States Patent
Scott et al.

(10) Patent No.: US 9,868,127 B2
(45) **Date of Patent: *Jan. 16, 2018**

(54) LIQUID REFILLING SYSTEM AND DEVICES

(71) Applicant: Noxell Corporation, Hunt Valley, MD (US)

(72) Inventors: Daniel Scott, Littlewick Green (GB); Andrew Graham Masters, Windlesham (GB); Georgina Lyndsey Claire Milich, Egham (GB)

(73) Assignee: Noxell Corporation, Hunt Valley, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/339,118

(22) Filed: Oct. 31, 2016

(65) Prior Publication Data

US 2017/0113237 A1 Apr. 27, 2017

Related U.S. Application Data

(63) Continuation of application No. 14/795,215, filed on Jul. 9, 2015, now Pat. No. 9,480,999.

(30) Foreign Application Priority Data

Jul. 23, 2014 (EP) ..... 14174049

(51) Int. Cl.
*B05B 11/00* (2006.01)
*A45D 34/02* (2006.01)
*B67D 7/02* (2010.01)

(52) U.S. Cl.
CPC ..... *B05B 11/0097* (2013.01); *A45D 34/02* (2013.01); *B05B 11/0016* (2013.01);
(Continued)

(58) Field of Classification Search
CPC ..... B05B 11/0056; B05B 11/0097
(Continued)

(56) References Cited

U.S. PATENT DOCUMENTS 4,344,744 A 8/1982 Schuster et al.
5,524,680 A 6/1996 De Laforcade
(Continued)

FOREIGN PATENT DOCUMENTS

CN 107073498 A 8/2017
EP 2335833 B1 11/2014
(Continued)

OTHER PUBLICATIONS

"U.S. Appl. No. 14/795,215, Non Final Office Action dated May 10, 2016", 16 pgs.
(Continued)

*Primary Examiner* — Timothy L Maust
*Assistant Examiner* — Timothy P Kelly
(74) *Attorney, Agent, or Firm* — Schwegman Lundberg & Woessner. P.A.

(57) ABSTRACT

The disclosure relates to a liquid refilling system (10) having a parent device (201) and a child or portable travel device sized device (101) that can be releasably coupled to the parent device (201) to transfer liquid from the parent to the child device. The parent device has a pump (207), an actuator (217) and an actuator stroke limitation means (218) whereby the amount of liquid dispensed by the parent device (201) can be selected as a single use predetermined amount or as a child refill amount. The parent pump is in liquid communication with the parent liquid reservoir and the pump has a volume which is substantially equal to the volume of the child.

20 Claims, 12 Drawing Sheets

(52) U.S. Cl.
CPC ..... *B05B 11/0056* (2013.01); *B05B 11/3001* (2013.01); *B67D 7/0205* (2013.01); *B67D 7/0294* (2013.01)

(58) Field of Classification Search
USPC ..... 141/2, 3, 18, 20, 113
See application file for complete search history.

(56) References Cited

U.S. PATENT DOCUMENTS

| | | | |
|---|---|---|---|
| 6,863,093 | B2 | 3/2005 | Garcia et al. |
| 8,079,388 | B2 | 12/2011 | Turgeman |
| 8,881,775 | B2 | 11/2014 | Turgeman |
| 8,950,447 | B2 | 2/2015 | De Rosa et al. |
| 8,978,938 | B2 | 3/2015 | Hui et al. |
| 9,146,144 | B2 | 9/2015 | Hui et al. |
| 9,480,999 | B2 | 11/2016 | Scott et al. |
| 2011/0297275 | A1 | 12/2011 | Farrar et al. |
| 2012/0205401 | A1 | 8/2012 | Litten et al. |
| 2013/0019992 | A1 | 1/2013 | Feriani et al. |
| 2013/0126639 | A1 | 5/2013 | Tu |
| 2016/0023227 | A1 | 1/2016 | Scott et al. |
| 2016/0023228 | A1 | 1/2016 | Scott et al. |

FOREIGN PATENT DOCUMENTS

| | | | |
|---|---|---|---|
| WO | WO-02/052977 | A2 | 7/2002 |
| WO | WO-2005/101969 | A2 | 11/2005 |
| WO | WO-2010/094963 | A1 | 8/2010 |

OTHER PUBLICATIONS

"U.S. Appl. No. 14/795,215, Notice of Allowance dated Aug. 26, 2016", 7 pgs.
"U.S. Appl. No. 14/795,215, Response filed Aug. 10, 2016 to Non Final Office Action dated May 10, 2016", 14 pgs.
"European Application Serial No. 14174049.8, Communication Pursuant to Article 56(1) EPC dated Jul. 21, 2014", 2 pgs.
"European Application Serial No. 14174049.8, Extended European Search Report dated Apr. 22, 2015", 6 pgs.
"European Application Serial No. 14174049.8, Response filed Nov. 10, 2016 to Extended Search Report dated Apr. 22, 2015", 5 pgs.
"European Application Serial No. 14174051.4, Extended European Search Report dated Apr. 22, 2015", 6 pgs.
"European Application Serial No. 14174051.4, Office Action dated Aug. 31, 2016", 1 pgs.
"European Application Serial No. 14174051.4, Response filed Nov. 10, 2016 to Office Action dated Aug. 31, 2016", 4 pgs.
"International Application Serial No. PCT/US2015/039842, International Preliminary Report on Patentability dated Feb. 2, 2017", 8 pgs.
"International Application Serial No. PCT/US2015/039842, International Search Report dated Sep. 23, 2015", 3 pgs.
"International Application Serial No. PCT/US2015/039842, Written Opinion dated Sep. 23, 2015", 6 pgs.
"Chinese Application Serial No. 201580040837.1, Notice of Passing Preliminary Examination dated May 17, 2017", 1 pg.

LIQUID REFILLING SYSTEM AND DEVICES

RELATED APPLICATIONS

This application is a continuation application of U.S. patent application Ser. No. 14/795,215, filed on Jul. 9, 2015, now issued as U.S. Pat. No. 9,480,999, which claims priority to European Patent Application Serial No. 141740498, filed on Jul. 23, 2014, which applications are incorporated herein by reference in their entirety.

FIELD

The present disclosure relates to methods, devices, and systems for refilling a liquid dispenser, such as a perfume dispenser.

BACKGROUND

Perfume dispensers are known in the art. Many perfume dispensers are bulky and unsuitable for convenient storage in small purses, handbags, and the like. One solution is to provide a perfume dispenser that is conveniently sized for storage in a purse or handbag. The small size of such a perfume dispenser, however, limits the amount of liquid perfume that it can store. Therefore, it is often desirable that these smaller perfume dispensers (hereinafter referred to as child device) have the ability to be refilled from a larger reservoir. Such reservoirs are typically also provided in the form of a perfume dispenser that preferably also has the ability to apply an atomized perfume when desired, thereby providing a convenient applicator for use in the home (hereinafter referred to as the parent device).

Some examples of refilling systems are described in WO 02/052977, WO 05/101969, U.S. Pat. No. 5,524,680 and WO2010094963. Whilst these devices may be satisfactory for their intended purpose, a continuing challenge is to provide a perfume dispenser that can atomize a liquid perfume for application by a user, which is travel sized and can be conveniently and easily refilled from another larger parent reservoir without undesirable spilling or accidental discharge of the liquid perfume during the refilling process. In particular, currently available refill perfume systems have a number of disadvantages. Firstly, the refilling process typically involves at the least the partial dis- and reassembly of the actuator of the atomizer of parent device, by the user to reveal the pump stem prior to its insertion into the base of the child device. This is both inconvenient and messy for the consumer and may also result in inadvertent damage to the parent actuator, which may prevent its subsequent effective functioning. Secondly, the refilling systems also utilize the pump of the parent as the refill mechanism for the child device. Since the parent pump is designed to dispense a standard single perfume dose directly to a user, a single actuation thereof will not completely fill the reservoir of a child device. Consequently, refilling of the child requires multiple parent pump activation steps by the consumer in order to completely refill the child device. Again, this is inconvenient and time consuming for the user. Moreover, it also requires a degree of dexterity in order to hold both devices securely during the refilling process. Nevertheless the use of these devices may still also result in spillage onto the parent and or child device, onto adjacent surfaces and users' hands themselves further exacerbating the possibility of inadvertently releasing the hold of the devices and spillage.

Alternative refill systems still require the partial disassembly of the child device and the use of a device such as a funnel to decant the liquid from the parent reservoir to the child device. Such devices also suffer from problems of potential spillage and mess as discussed above.

Other refill systems function by the incorporation of a suction pump such as described in U.S. Pat. No. 6,863,093 and EP2335833. These systems must be provided with a prefilled child device, whereby a vacuum is generated in the child device as the liquid is evacuated during use. However, in order to enable subsequent refilling, the vacuum must be generated consistently upon expulsion of the liquid from the child reservoir. Typically, such devices are unable to maintain a vacuum over time and the child device can therefore no longer be refilled and reused. Moreover, such devices also require partial disassembly and accurate docking between the parent and child device in order to prevent inadvertent damage to the vacuum rendering the mechanism and child device redundant.

WO2010/094963 describes an automated refill system comprising a bellows pump, whereby the child device is refilled upon coupling to the parent device. Such systems are however complex to manufacturer and require specialized materials for the bellows in order to function with fragrance compositions.

Thus, there is still a need to provide a perfume refill system whereby the child device can be readily refilled from a parent device utilizing a convenient disassembly mechanism for the parent device, thereby reducing inconvenience and mess. Moreover, there is a need for a device which also does not require multiple parent pump activations in order to refill the child device completely. Furthermore, the system should enable simple, preferably intuitive docking of the child to the parent. There is also a need for a system, the construction of which does not result in complex manufacturing processes.

SUMMARY

The disclosure relates to a liquid refill system (10), preferably for a fragrance composition comprising:

a) A child device (101) having a liquid reservoir (103) having a volume ($V_{CR}$) and an air outlet valve said device (101) having a first portion (105) having a dispensing mechanism (107) and a second portion (106) having a child refill mechanism (108) comprising a child liquid inlet (110) and a child one way liquid inlet refill valve (111) associated therewith;

b) A parent device (201) having a liquid reservoir (203) containing a liquid and preferably an air inlet valve (204) said device (201) having a first portion (205) having a parent refill mechanism (208) and a liquid outlet (213) having a one way liquid valve (212), associated therewith, said parent device (201) having a pump (207) and an actuator (217) releasably attached to said parent device, wherein said pump has a pump volume ($V_{PP}$), in liquid communication with the parent liquid reservoir (203) via a one way liquid inlet valve (211) and in liquid communication with said liquid outlet (213) and optionally having a liquid return valve (212), wherein the ratio of the volume of the parent pump (Vpp) to the volume of the child liquid reservoir (Vcr) is 12:1 or less, preferably 1:1;

said actuator (217) having an actuator stroke limitation means (218), whereby the maximum volume (Vpa) of liquid dispensed upon actuation of the actuator (217) is predetermined and less than said pump volume (Vpa).

According to the disclosure said actuator is releasably detached from said parent device and the child refill mechanism (108) is coupled to the parent refill mechanism (208) preferably in a substantially co-linear configuration, such that upon each single actuation of the parent pump (207), a seal is formed around a liquid pathway which extends from the parent outlet (213) to the child liquid inlet (110) and the child one way liquid inlet refill valve (111) of the child reservoir (103), through which the liquid contained in the parent pump (207) is transferred to the child reservoir (103), whilst air is expelled from the child reservoir via the child air outlet valve. Upon termination of the actuation of the parent pump (207), the seal and the liquid pathway are disconnected, and the parent pump (207) refills with liquid from the parent reservoir (203) via the parent one way liquid inlet valve (211) and inlet (210), and air enters the parent reservoir (203) via the air inlet valve (204). The parent pump (207) is actuated at least once and can be repeatedly actuated and refilled, at least twice, until the child reservoir (103) is filled with the desired amount of liquid. The child refill mechanism (108) is then decoupled from the parent refill mechanism (208) and said actuator is reattached to said parent pump (207). The parent and child device are then both able to dispense fluid.

DETAILED DESCRIPTION

Figure 1A:
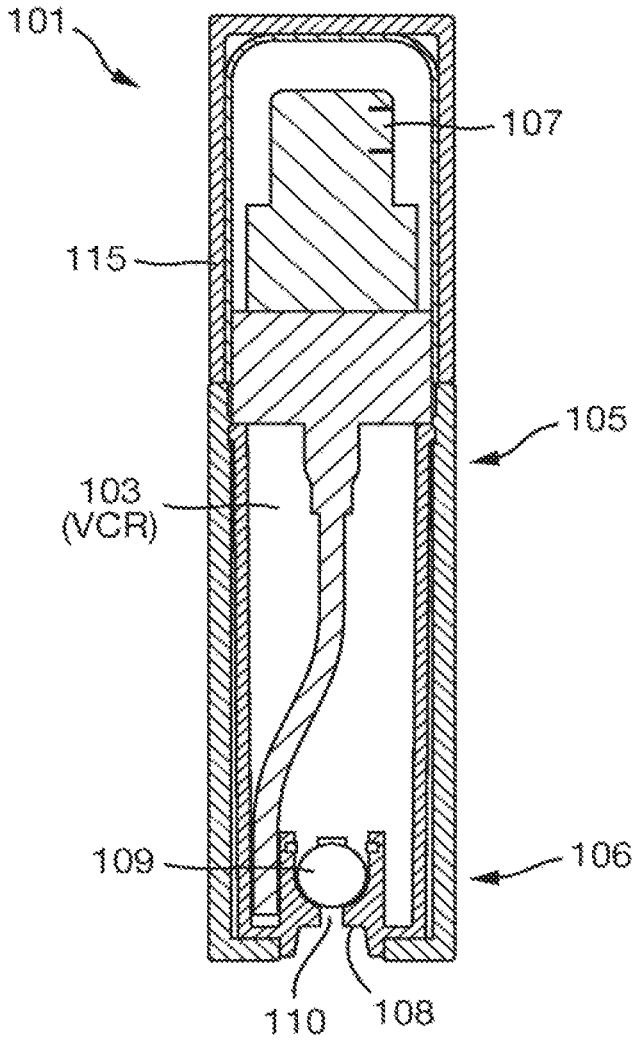
FIGS. 1*a* and 1*b* are cross sectional views of one embodiment of the child device wherein the one way liquid inlet valve is open and closed respectively.

The present disclosure provides a novel and unique liquid refilling system comprising a parent device and a child or portable travel sized device that can be releasably coupled to the parent device to transfer liquid from the parent to the child device. The parent device is provided with a pump in liquid communication with a parent reservoir containing the liquid. The pump of the parent device has a volume which is preferably substantially equal to the volume of the child reservoir thereby enabling a minimal number of single actuations of the parent pump to completely fill the child reservoir if desired upon coupling thereof. Consequently, the necessity for multiple parent pump actuations as in the prior art is avoided. In one embodiment, the parent device is provided with a parent actuator detachment means to facilitate the removal of the parent actuator, and minimize and/or eliminate undesirable spilling and spraying of the liquid perfume during the refilling process. In a preferred embodiment, the parent device is provided with a cap, preferably comprising the parent actuator detachment means.

The present disclosure may find utility for any personal beauty care compositions such skin care, grooming, body care, or oral care liquid may be also be used. Some non-limiting examples include after shaves, UV skin care compositions, skin care moisturizers, hand sanitizing compositions, and mouth rinses. Some non-limiting examples are described in U.S. Pat. No. 5,883,059 and US2005/0169852. The disclosure finds particular utility as a fragrance composition.

Any fragrance compound, or combinations thereof, may be employed with the present disclosure. In some embodiments, the fragrance compounds may be derived from any suitable plant or synthetic material as described for example in Steffen Arctander "Perfume and Flavor Chemicals (Aroma Chemicals Vol. 1 and 2, 1969). Some non-limiting examples of liquid perfumes are described in U.S. Pat. Nos. 7,413,731; 7,208,464; and 7,763,742. While the present disclosure will be described herein with reference to the use of fragrance composition perfume for purposes of illustration, it will be appreciated that other personal beauty care compositions and or shave care and hair removal compositions and devices may be used with the present disclosure as described above. The compositions for use herein are provided in a liquid form including creams and gels and may have a viscosity in the range of from 0.001 Pas to 40 Pas, preferably from 0.001 to 20 Pas more preferably from 0.001 Pas to 10 Pas, most preferably from 0.001 Pas to 1 Pas measured at 25° C. For fragrance compositions the viscosity will preferably be in the range of 0.001 to 0.5 Pas. Accordingly, the skilled person will select pumps, inlets and associated valves dependent upon the viscosity of the liquid to be transferred.

The liquid refill system comprises a parent device and a child device. The parent device comprises a parent liquid reservoir for storing a liquid and an optional air inlet valve. These devices may be provided from any suitable material and are typically manufactured from glass or plastic materials. The volumetric capacity of the parent liquid reservoir can vary widely depending upon the intended use and the nature of liquid stored in the parent liquid reservoir. For example, in one embodiment wherein the parent and child devices are intended for home consumer usage, the parent liquid reservoir has a liquid capacity of greater than 30 ml, or 50 ml, or 75 ml and/or less than 500 ml, 300 ml, or 150 ml, or 100 ml. The child liquid reservoir may have a liquid capacity of 3 ml or greater, 5 ml or greater or 7 ml or greater or 10 ml or greater and or less than 20 ml or 15 ml. In an alternative embodiment where for example the parent device is made available to a consumer at a retail outlet so that the consumer can refill the child device in store, the parent liquid reservoir will typically be provided with a much larger capacity such as greater than 0.5 L, 1 L, or 10 L or 15 L or 20 L. The child device may be provided with a liquid reservoir capacity of greater than 5 ml, or 7 ml or 10 ml or 30 ml or 50 ml or 100 ml. The parent air inlet valve is typically located in the first portion of the parent device and may in some embodiments be located within the pump. The parent air inlet valve ensures that the air pressure inside the parent device is at equilibrium with the external air pressure as the liquid is discharged from the parent device upon filling the child device with liquid therefrom.

The parent device has a pump which is in liquid communication with a reservoir and has an actuator which is releasably attached to the pump optionally by a collar. The actuator enables the dispensation of liquid from the reservoir via the pump and liquid outlet thereof, typically in combination with a spray head which is depressed to activate the pump and deliver the liquid such as a fragrance in the conventional manner. In order to enable the parent pump to provide both a single use predetermined amount of liquid and also to enable refilling of the child reservoir without the need for multiple actuations, the actuator is provided with an actuator stroke limitation means. The actuator stroke limitation means restricts the amount of liquid that is delivered by the pump from the parent reservoir so that it is less than the volume of the parent pump. The stroke limitation means thereby ensures the delivery of the conventional amount of liquid from the parent device when used independently as a standalone dispensing device. The maximum volume of liquid dispensed upon actuation of the actuator (Vpa) is predetermined and is typically 0.2 ml or less, preferably 0.1 ml or less, more preferably 0.7 ml or less, most preferably 0.5 ml or less.

The maximum volume of liquid dispensed upon actuation of the actuator (Vpa) is less than said pump volume. The maximum volume of liquid dispensed upon actuation of the actuator (Vpa) may be from 5% to 80% of the pump volume (Vpp), preferably from 5% to 50% of the pump volume and is dependent primarily upon the volume of the parent pump. The ratio of said maximum volume (Vpa) to said pump volume (Vpp) may be from 1:20 to 4:5, preferably from 1:10 to 1:5, more preferably 3:4.

Upon removal of the actuator and consequently the actuator stroke limitation means from the parent device, the entire volume of the parent pump is accessible when the child device is attached, thereby allowing the refilling of the child reservoir when connected without multiple parent pump actuations.

The actuator stroke limitation means may be any suitable means to prevent the actuator from dispensing of the entire volume of the parent pump. Suitable means include means to reduce the stroke length such as by a simple physical stop located in the path of the actuation stroke to prevent the completion of the actuator stroke, a physical stop which is activated by rotating the actuator for example by use of a screw thread or click mechanism, a valve situated in the actuator path which closes upon contact during the stroke actuation, or by rotation of the actuator as described above. The stroke limitation means is positioned in order to ensure the single use predetermined amount is obtained and will vary depending on the total pump volume. The stroke limitation means may be concealed from the user within the actuator itself or it may be externally visible. The stroke limitation means may utilize a feature already present in the parent device.

Figure 2:
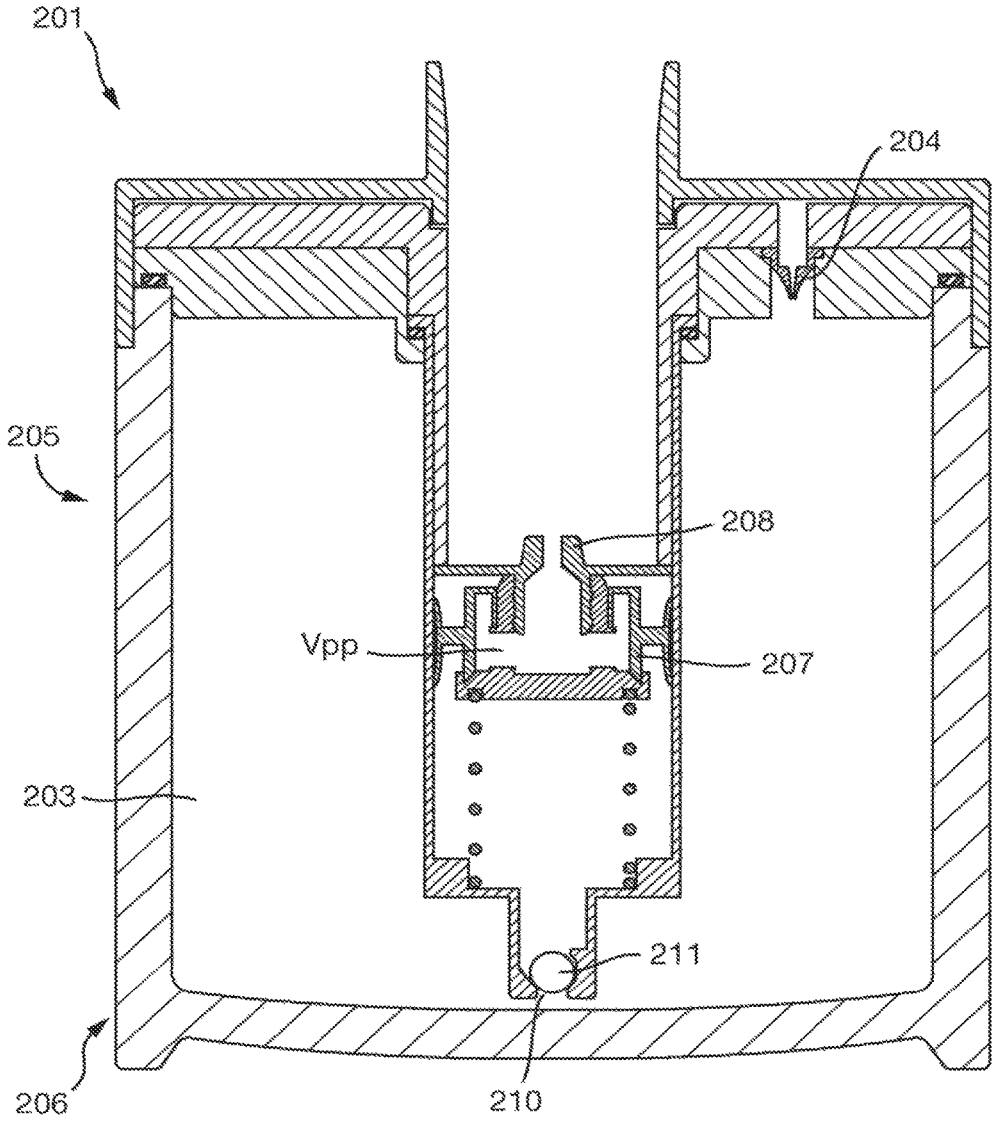
FIG. 2 is a cross sectional view of one embodiment of the parent device after removal of the actuator.
Figure 3:
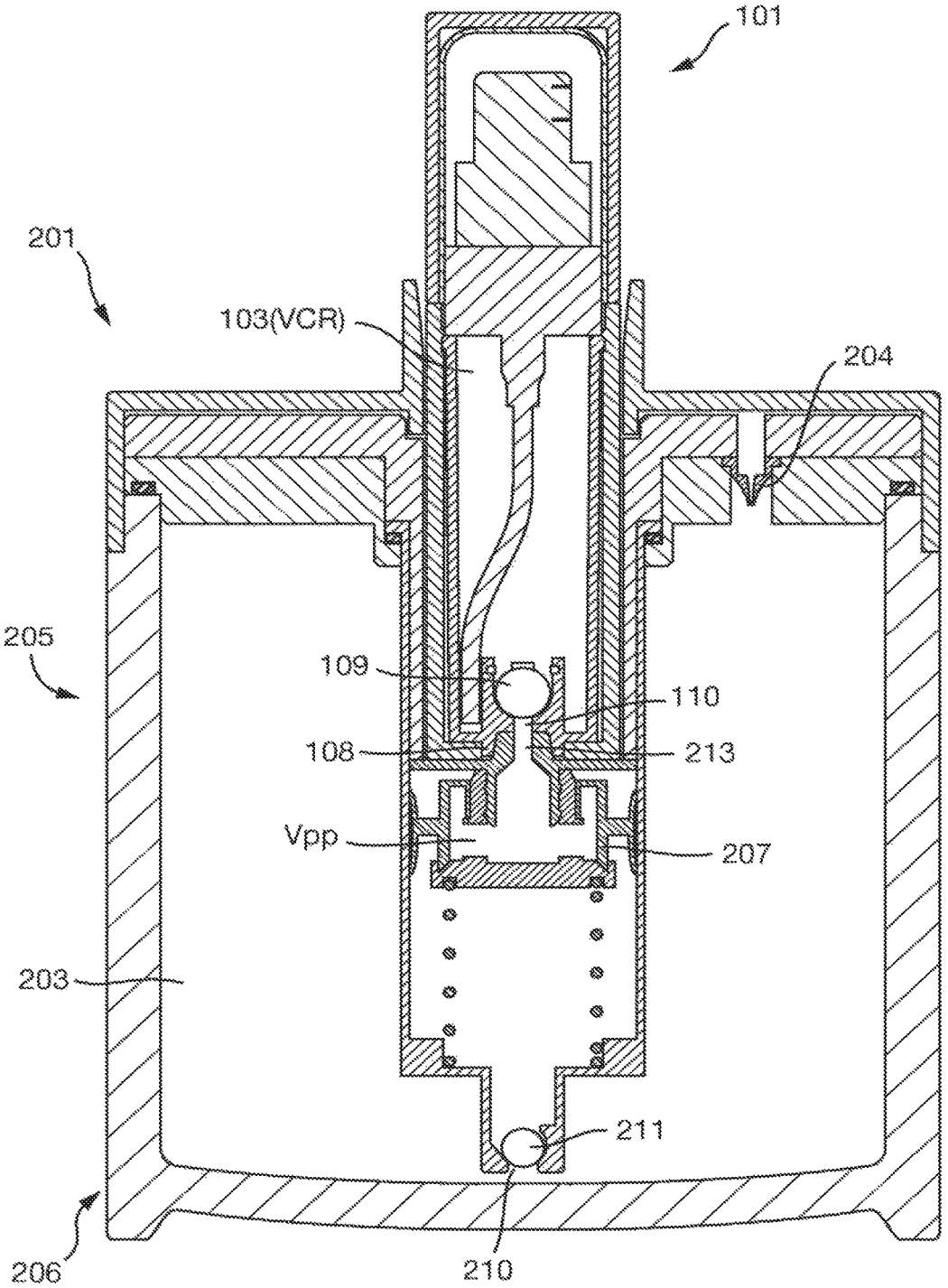
FIG. 3 is a cross sectional view of the child and parent of FIGS. 1*a* and 2 coupled together prior to the transfer of liquid.
Figure 4:
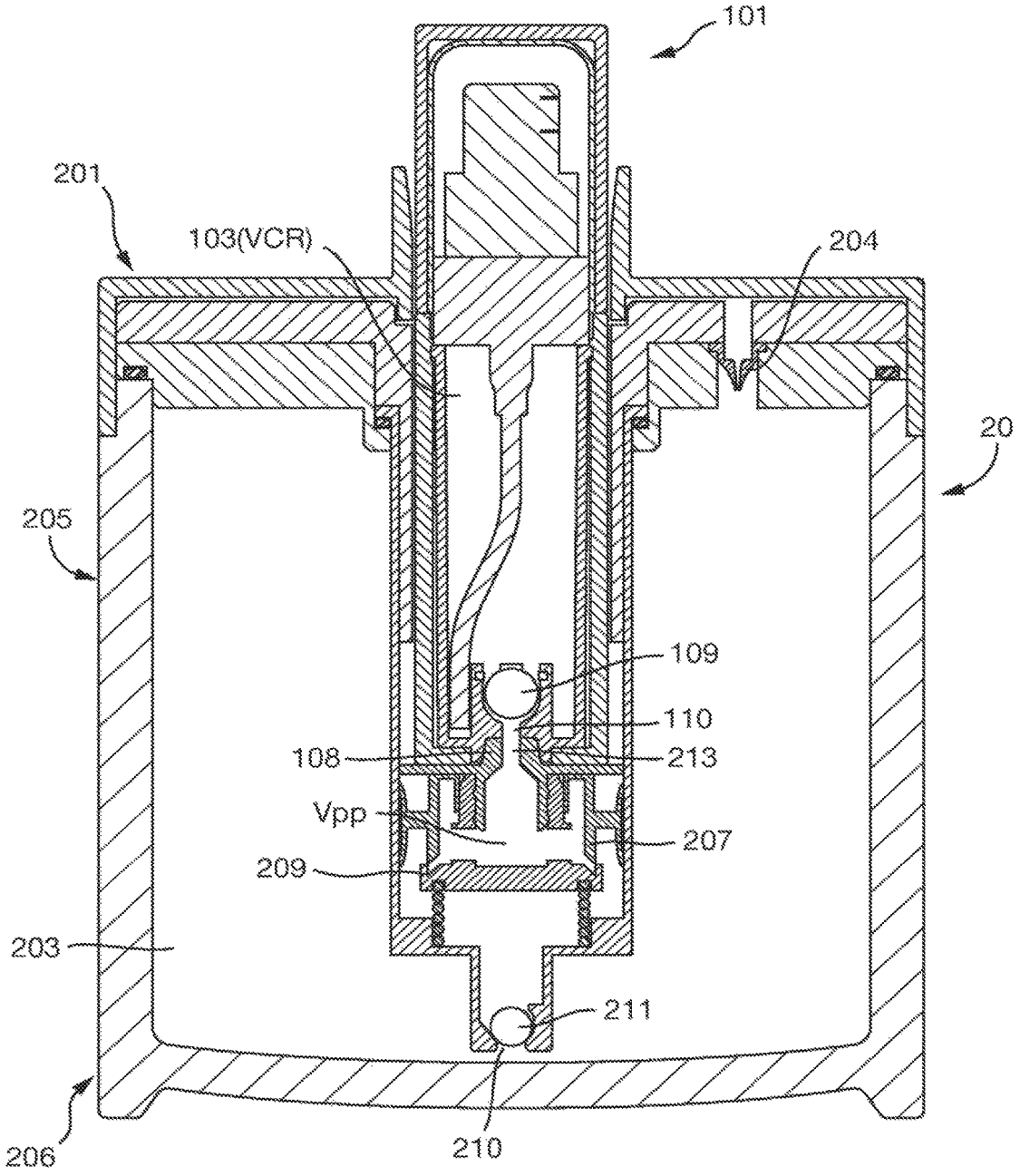
FIG. 4 is a cross sectional view of the child and parent of FIGS. 1*b* and 2 coupled together during liquid transfer.

Referring to FIG. 2, the parent device (201) following the removal of the actuator is shown. The parent device has a first portion (105) having a parent refill mechanism (208) and a liquid outlet (213) having a one way valve (209) associated therewith to control the flow of liquid from the parent device (201) to the child device (not shown). The first portion of the parent may be provided with a cap or cover for protection. The parent device (201) further comprises a pump (207) which is in liquid communication with the parent liquid reservoir (203) via a one way liquid inlet valve (210) and also in liquid communication with the parent liquid outlet (213) which enables the liquid contained in the parent reservoir (203) to be transferred to the child reservoir through the pump (207) to the one way liquid outlet (213).

Preferably, the parent one way liquid inlet valve is in fluid communication with a fluid pick up means such as a dip tube (not shown) to ensure that liquid can be extracted from the lower portion and base of the parent liquid reservoir. The dip tube diameter may be varied to control the rate of liquid transfer as required. In an alternative embodiment the parent pump is configured such that it extends to the base of the parent liquid reservoir, which may optionally be provided with a sump, in order to extract all the liquid contained in the parent reservoir. In order to fill the child device with a minimum number of pump actuations the volume of the parent pump (Vpp) and the volume of the child reservoir (Vcr) should be similar. The ratio of the volume of the parent pump to the volume of the child reservoir is thus 12:1 or less, preferably 10:1 or less, more preferably 5:1 or less, even more preferably 3:1 or less. This corresponds to about 12, or less, 10 or less, 5 or less or 3 or less parent actuations in order to substantially fill the child reservoir; if the child reservoir is substantially empty prior to filling. The user may therefore decide if the child reservoir is to be completely filled or not. In an alternative embodiment, if the child is not substantially empty upon commencing the refilling process, the user may select to refill the empty portion thereof.

Preferably in order to enable the child device to be filled by a single actuation of the parent pump, the parent pump liquid volume (Vpp) is such that it is substantially equal to the volume of the child reservoir (Vcr) so that Vpp:Vcr is 1:1. Thus, if the child device is substantially empty prior to filling and does not contain any liquid, the refilling procedure will result in the child reservoir being refilled to substantially its maximum capacity (Vcr).

In circumstances where the child reservoir is not completely empty prior to filling, or the consumer does not desire to completely refill the child reservoir, and where the ratio of the parent pump liquid volume (Vpp) to child reservoir volume is 12:1 or less, preferably 10:1 or less, the number of actuations required can be determined by visual inspection of the child device and reservoir by the consumer and or by the tactile cue due to for example the change of actuation force.

Figure 5:
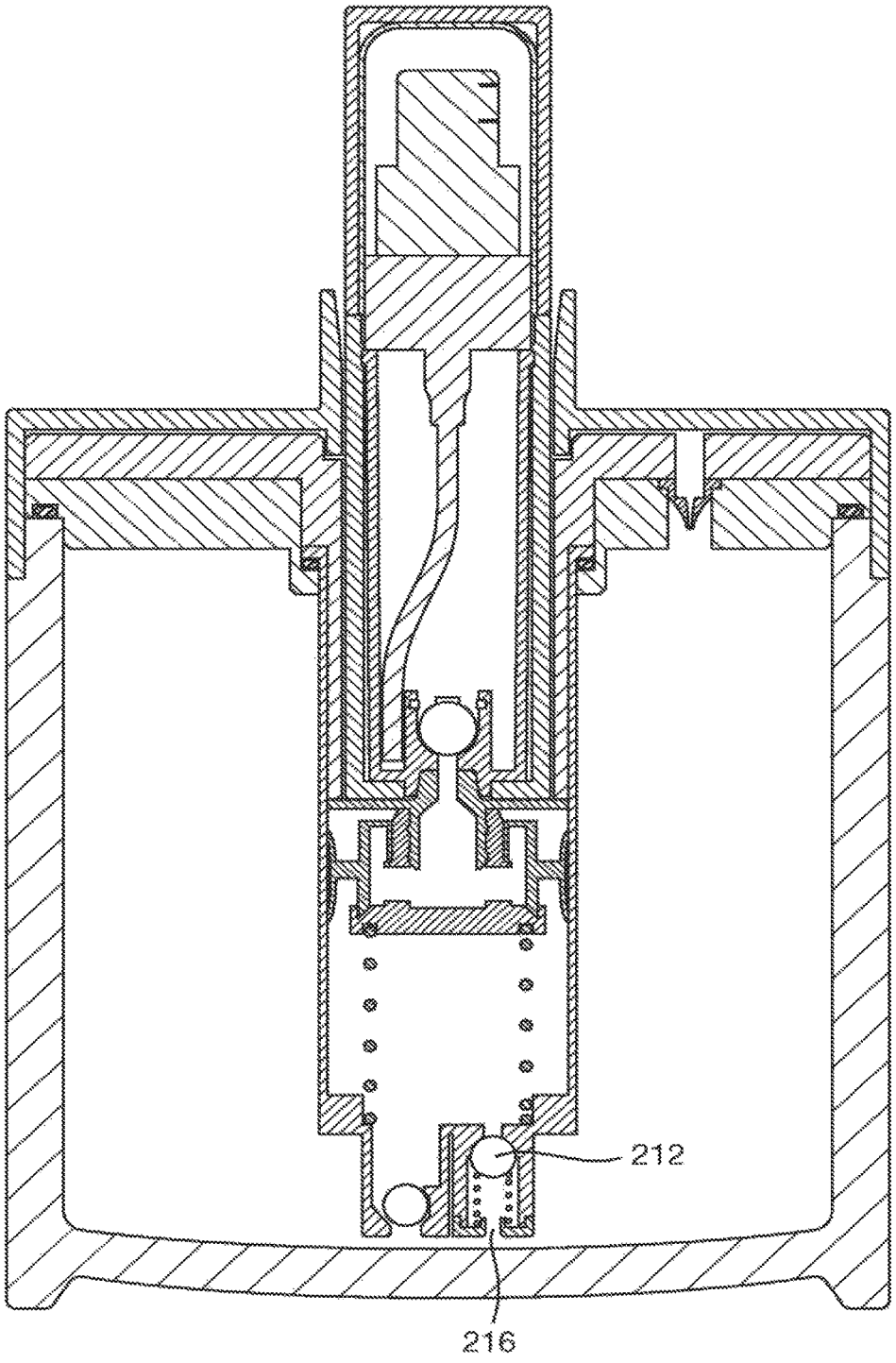
FIG. 5 is a cross-sectional view of the child device of FIG. 1*a* coupled to an alternative embodiment of the parent device having a return valve, after removal of the actuator, prior to the transfer of liquid.
Figure 6:
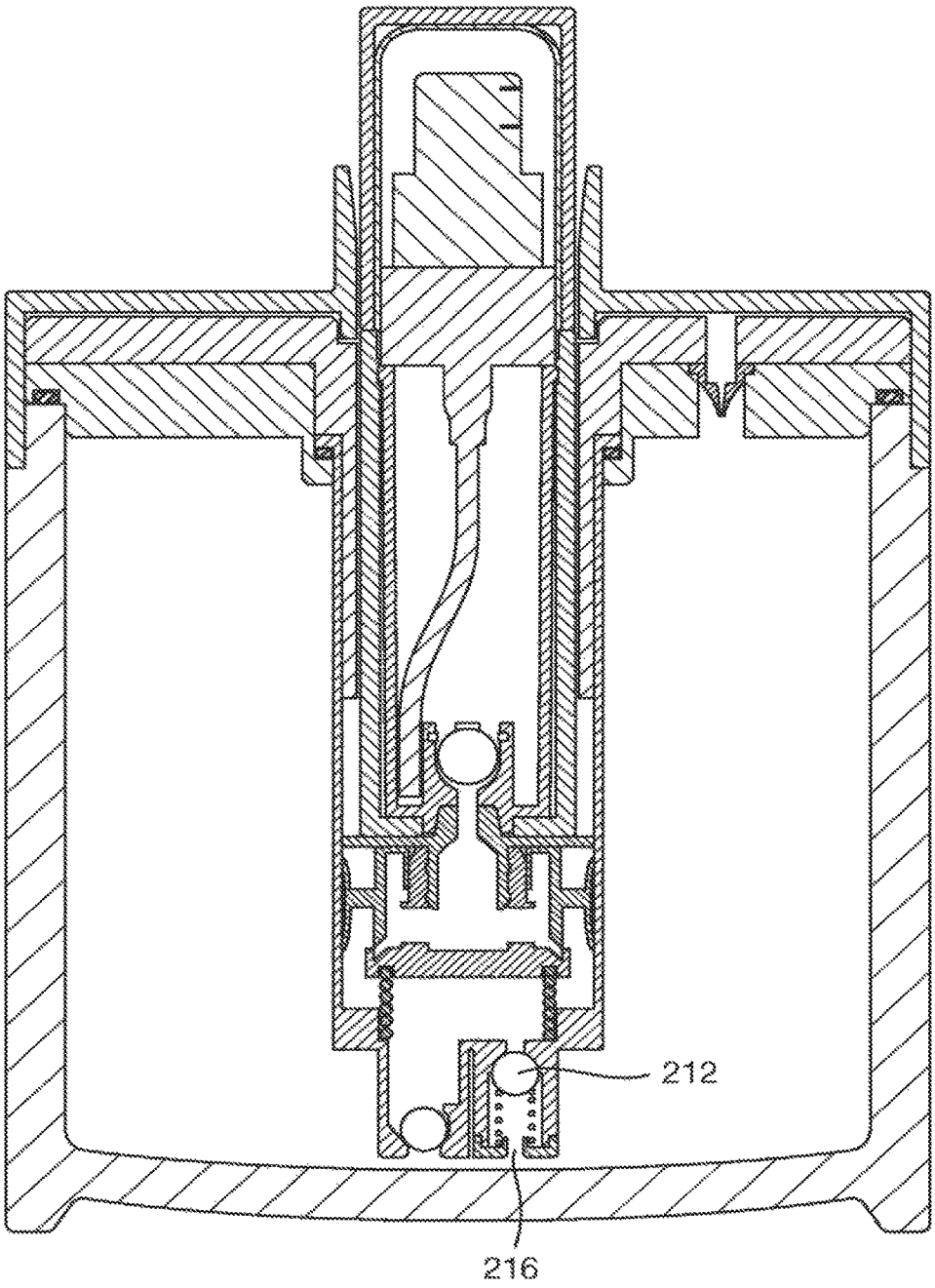
FIG. 6 is a cross sectional view of the child device of FIG. 1*b* coupled to an alternate embodiment of the parent device after removal of the actuator having a return valve, during liquid transfer.
Figure 7:
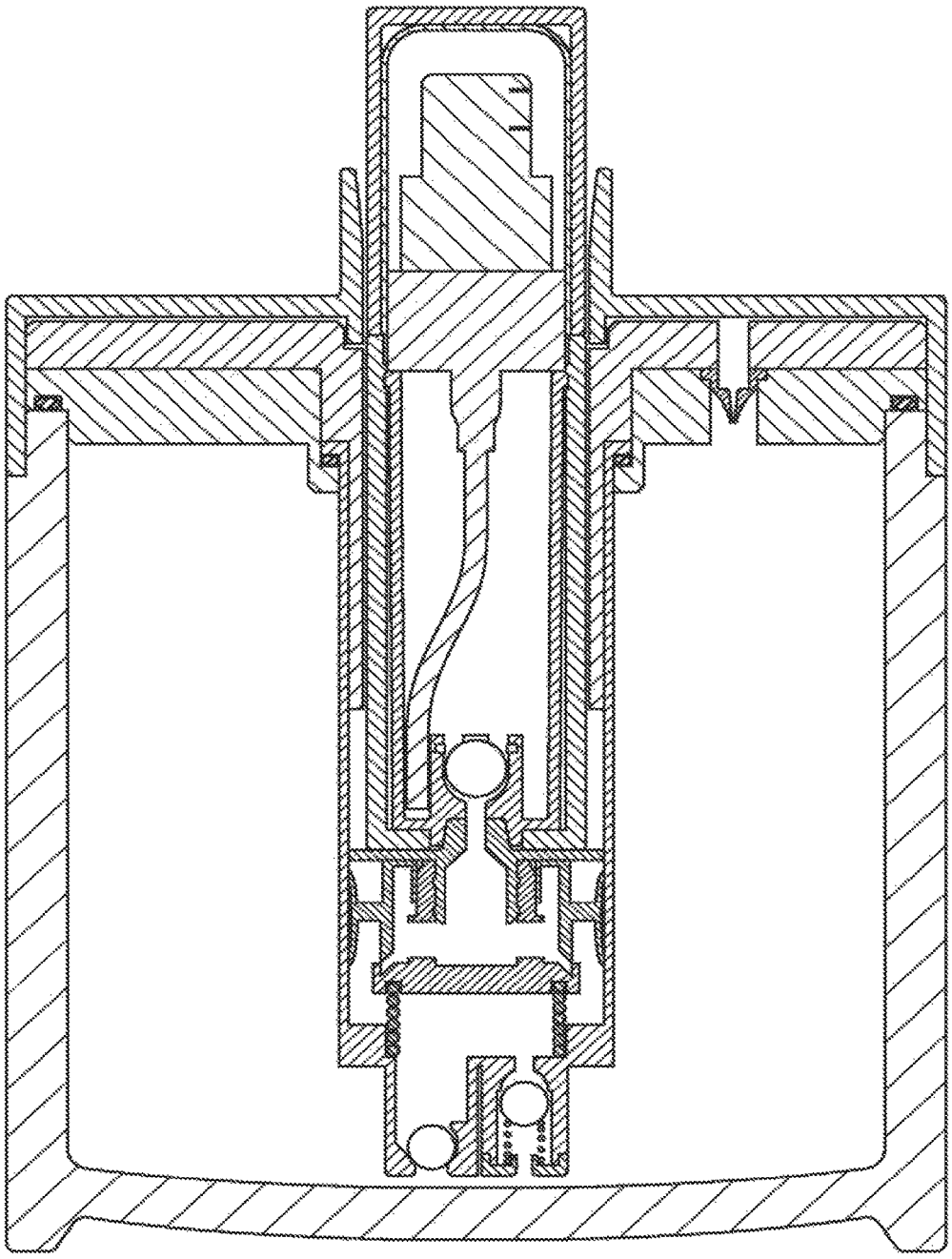
FIG. 7 is a cross sectional view of the child device of FIG. 1*b* coupled to an alternative embodiment of the parent device after removal of the actuator during excess fluid evacuation via the return valve.

In a preferred embodiment as illustrated in FIG. 5-7, the parent pump (207) is provided with a liquid return valve (212) and associated return valve outlet (216) to enable any excess liquid not transferred to the child reservoir to be returned to the parent pump and reservoir. FIG. 7 illustrates the open position of the liquid return valve (212). This is beneficial in circumstances when the child device reservoir is not completely empty prior to filling and thus the parent pump volume may be greater than the available child reservoir volume. The term substantially equal as used herein means that the volume of the parent pump is about 20%, preferably about 15%, more preferably about 10%, even more preferably about-5%, most preferably about less than 3% of the volume of the child reservoir. If a return valve is not present, any excess liquid may be expelled from the child dispenser via the air outlet valve.

Figure 8A:
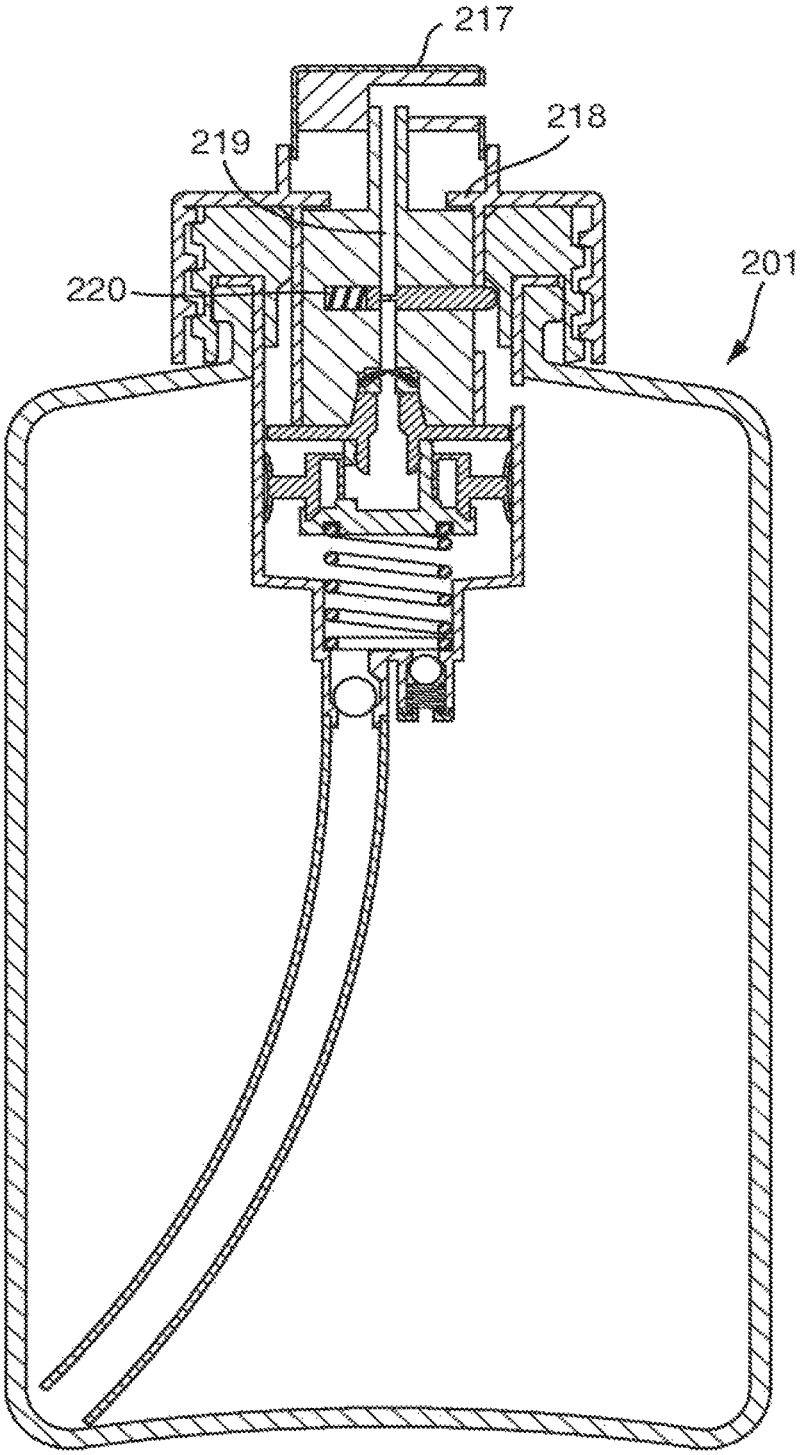
FIGS. 8*a* and 8*b* are cross sectional views of one embodiment of the parent device, wherein the actuator is attached and detached respectively from the parent device.
Figure 8B:
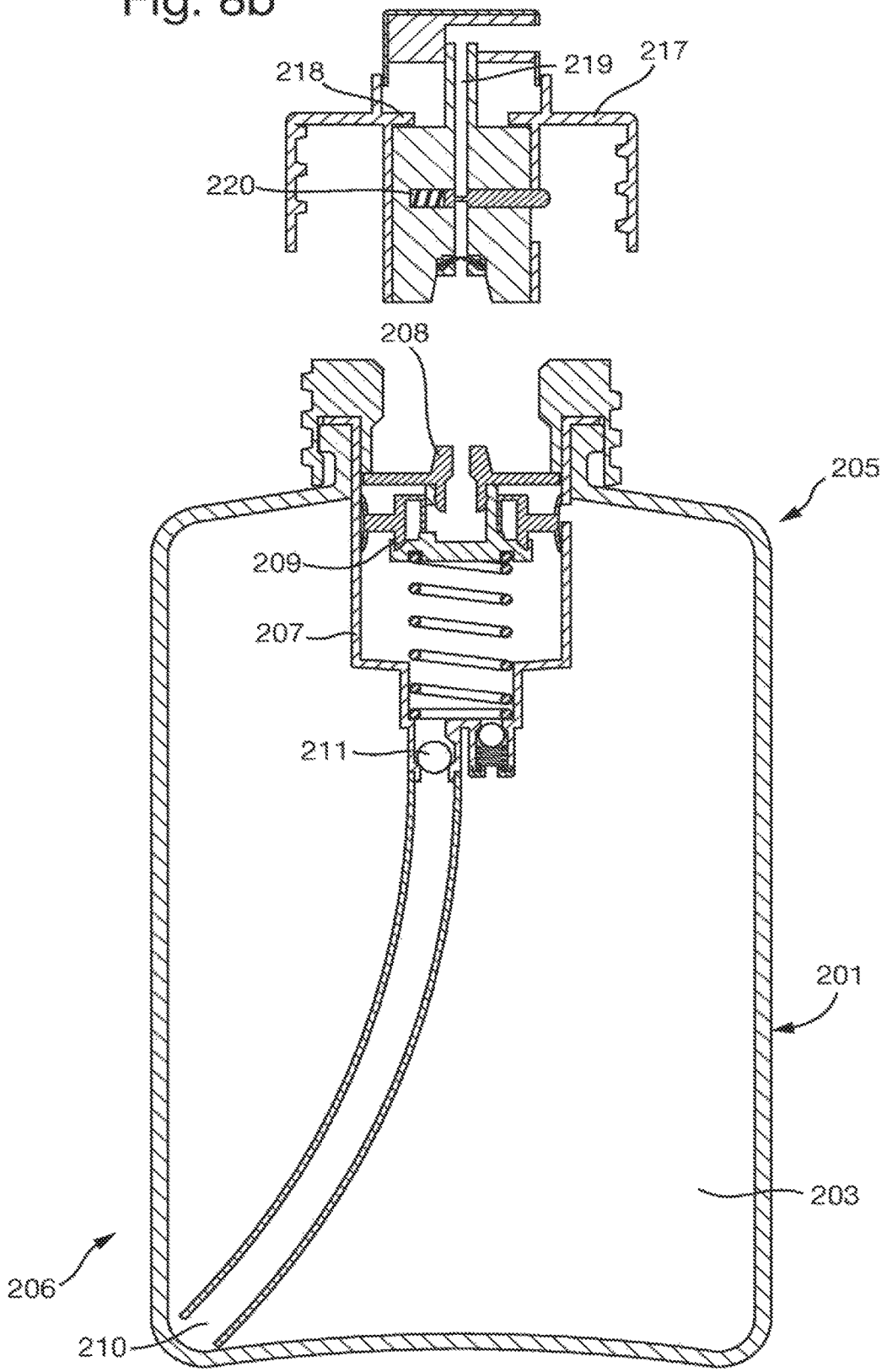

FIGS. 8*a* and 8*b* illustrate a parent device (201) having a pump (207) and an actuator ((217) releasably attached to the device. The actuator (217) has a stroke limitation means (218) which is provided by a physical stop located on the parent collar. The stroke length of the actuator (217) is limited by the interaction of the stroke limitation means (218) on the parent collar which thereby creates a physical stop to the stroke limitation means (218) and actuator stroke is stopped before completely the stroke length. The parent liquid outlet (219) may optionally be provided with an anti dripping mechanism (220) so as to prevent liquid contained in the outlet dripping out whilst the actuator (217) is being removed from the parent device (201).

In order to refill the child reservoir, the child refill mechanism is releasably coupled to the parent refill mechanism (208), preferably in a substantially co-linear configuration as illustrated in FIGS. 4-7. If present the parent cap is removed prior to coupling with the child.

Upon each single actuation of the parent pump (207), a seal is formed around a liquid pathway which extends from the parent outlet (213) to the child liquid inlet (110) and the child one way liquid inlet refill valve (109) of the child reservoir (103). The liquid contained in the parent pump (207) is transferred through the liquid pathway to the child reservoir (103), whilst air is expelled from the child reservoir (103) via the child air outlet valve (104). Upon removal of the actuation force, thereby terminating the actuation of the parent pump, the seal and the liquid pathway may be disconnected, and the parent pump (207) refills with liquid from the parent reservoir (203) via the parent one way liquid inlet valve (211) and inlet (210). Air also enters the parent reservoir via the air inlet valve (204).

Depending on the ratio of the volume of the parent pump and the child reservoir as described hereinabove, the parent pump may require repeated actuation and refilling until the child reservoir is substantially completely filled with liquid, if required. The user may therefore select whether or not to completely fill the child reservoir. After the child is filled, completely or partially child device may then be decoupled from the parent device (child and parent refill mechanism).

The term completely filled as used herein with regard to the child reservoir volume (Vcr) means that the reservoir is at least 75% filled with liquid, preferably at least 85% filled, more preferably at least 90% filled and even more preferably at least 95% filled and most preferably at least 98% filled.

In an alternative embodiment, the liquid reservoir of the parent device may be provided as a collapsible reservoir, commonly referred to as a bag in bottle. In such embodiments the parent air inlet is not required.

Referring to the FIGS. 2 to 10, the parent pump mechanism is provided as a spring biased positive displacement pump comprising a spring, a one-way ball valve, a pump chamber and a plunger. A dip tube is attached to the parent pump and extends into the parent reservoir for drawing the liquid fragrance from the parent reservoir (not shown). The liquid fragrance is discharged from the parent pump through the liquid outlet that may be integrally formed with the plunger. The parent pump may be attached to a fitting that is in turn attached to a collar of the parent device if present.

The pump spring(s) may be provided in number of alternative configurations in order to facilitate dispensation for single use and refilling of the child device. In one embodiment the spring may be configured to provide at least 2 distinct application forces, preferably an upper application force which is less than the lower application force and thereby resulting in the delivery of less dosage associated with the upper application forces in comparison to the lower application force. Such distinct application forces may be provided by the spring construction itself or by the provision of two linked springs. Embodiments having two linked springs may be vertically stacked or may be stacked in parallel preferably one spring contained within the second spring.

In certain embodiments, the actuation force for the pump mechanism (i.e., the force required to begin to displace the plunger against the biasing force of the spring) is between about 3 N and about 10 N. In other embodiments, the actuation force is between about 5 N and about 8 N.

It will be appreciated that the parent pump mechanism may be provided in wide variety of other configurations such as a diaphragm pump. Some non-limiting examples of suitable pump mechanisms are also described in U.S. Pat. Nos. 7,870,977 and 6,681,961.

The parent pump mechanism may be actuated by depressing the plunger toward the parent reservoir through the pump chamber. As the liquid outlet and plunger are displaced toward the parent reservoir, liquid within the pump chamber is pressurized due to the decrease in volume of the pump chamber and seating of the ball valve. Liquid within the pump chamber is then pumped out of the outlet. Once a complete downward stroke of the plunger has occurred, or if present the stroke is terminated due to the presence of the actuator stroke limitation means, the biasing force generated by compression of the spring will act to return the plunger to its original position. As the plunger travels away from the parent reservoir, the negative pressure generated by the volumetric expansion of the pump chamber unseats the ball valve and draws liquid through the dip tube from the reservoir into the pump chamber, after which the pump is primed for another pumping cycle.

The parent pump may be provided within a neck or collar of the parent device in order to secure the pump thereto with corresponding fitting means. Alternatively, a separate collar maybe used to secure the pump to the parent device.

Figure 9:
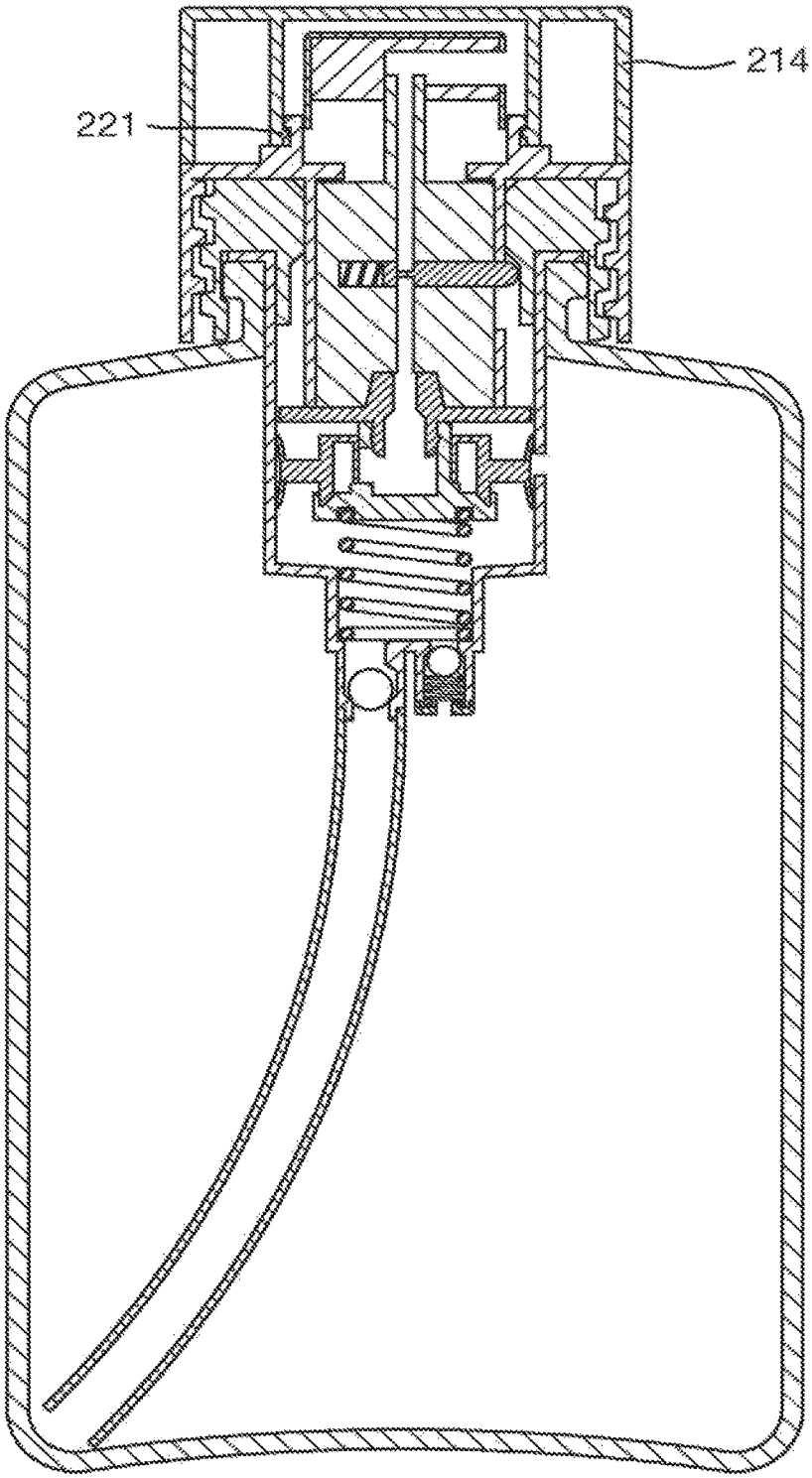
FIG. 9 is across sectional view of one embodiment of the parent device having a cap.
Figure 10:
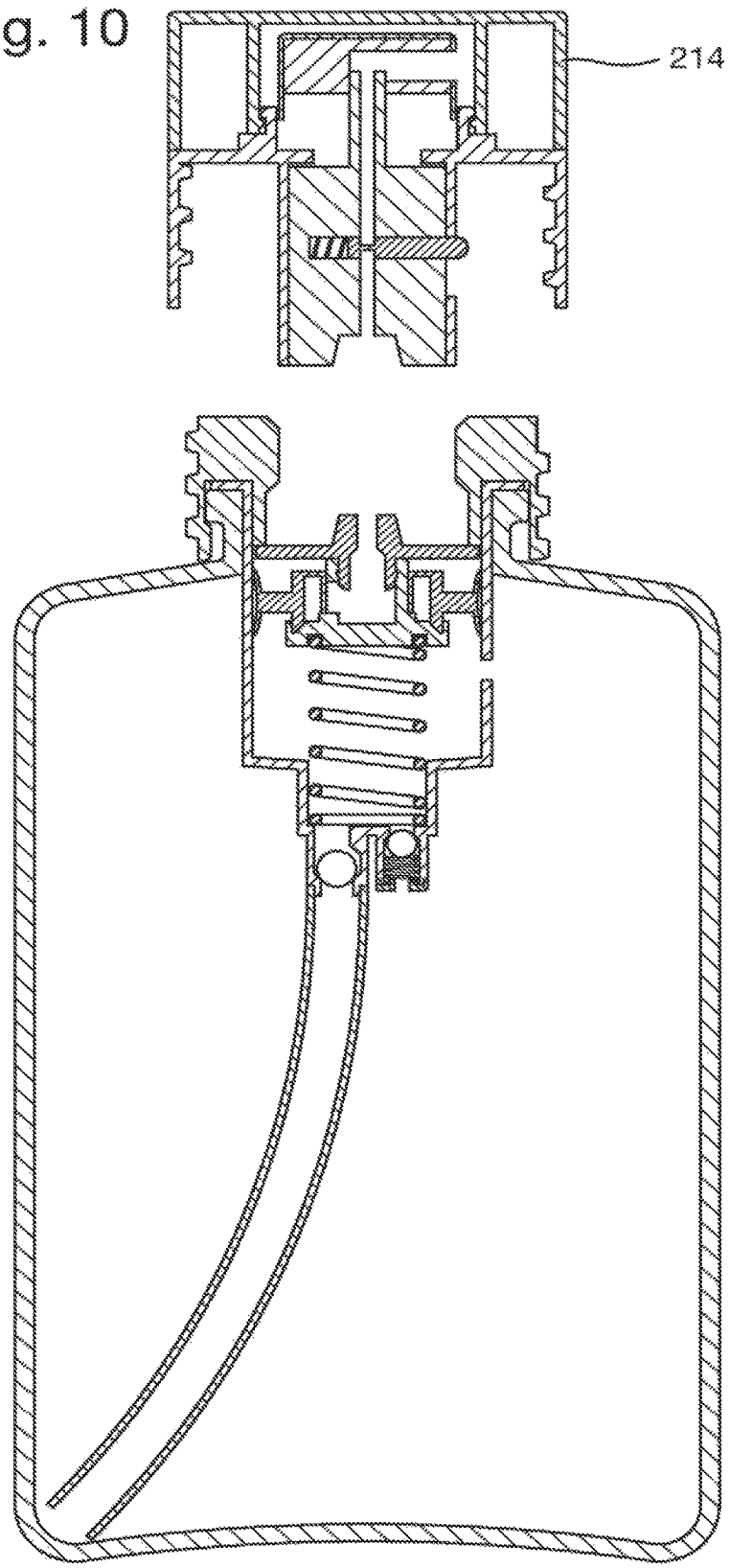
FIG. 10 is across sectional view to the embodiment of FIG. 9, wherein the cap and parent actuator are detached from the parent device.

Referring to FIGS. 9 and 10 in a preferred embodiment the parent device further comprises a protective cap (214). The protective cap (214) provides protection from the environment of the actuator and prevents contamination thereof. Preferably, the cap (214) is provided with a parent actuator detachment means (221), whereby the actuator is detached from the parent device and releasable connected to the protective cap upon removal of the cap from the parent device. Upon replacement of the protective cap onto the parent device, the actuator is released from the cap and re-attached to the parent device. The parent actuator detachment means may comprise a cap component and an actuator component, said components engaging with one another to releasably attach said cap to said actuator. The cap component is typically located on the cap and the actuator component is typically located on the actuator. Suitable parent actuator detachment means include screw thread, lock and key, lib locks, push closure, bayonets and the like which can be activated by the movement of the cap for example by rotational about its axis, application of pressure horizontally or vertically about its axis. Preferably the actuator is detached from said parent device upon rotation of said cap by at least 45°, preferably at least 90° about the central actuator axis.

In an alternative embodiment, the cap comprises a two component cap having an upper and lower portion. The upper cap portion is releasably attached to a lower cap portion. The lower cap portion comprising the parent actuator detachment means.

The cap can thus be removed so as to reveal the actuator of the parent device or alternatively may be activated to engage the parent actuator detachment means and remove the actuator from the parent device as shown in FIG. 10.

Figure 1B:
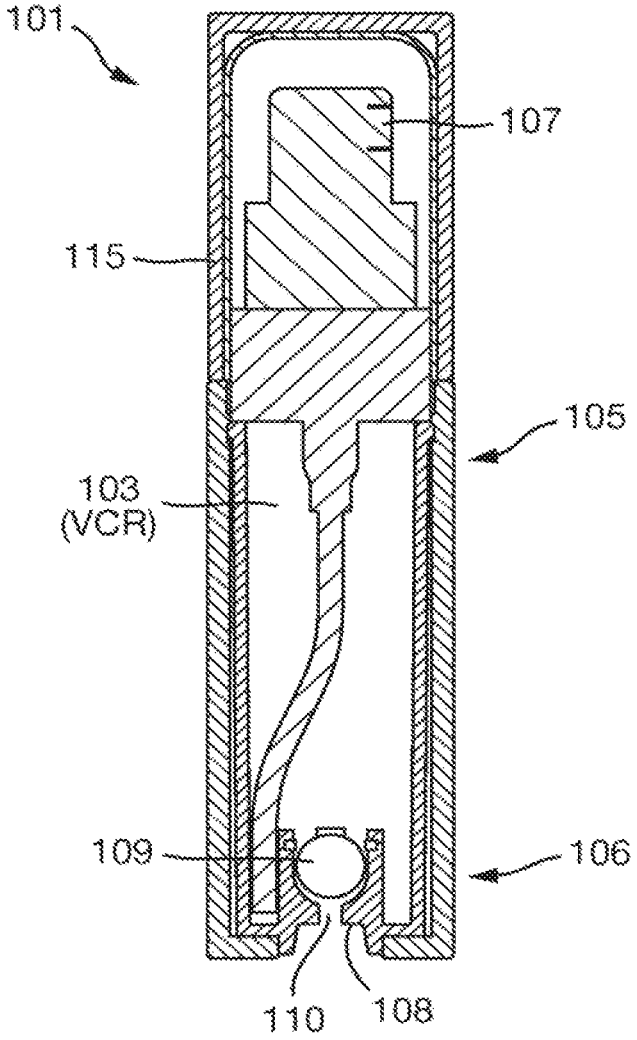

Upon removal of the actuator, an amount of liquid may be retained therein from the last liquid actuation, which may drip out upon removal of the actuator. The actuator may thus further be provided with an additional return valve which closes upon removal of the actuator from the parent device. Referring to FIGS. 1*a* and 1*b*, an embodiment of a child device (101) will now be described. The child device (101) comprises a liquid reservoir (103) having a volume (Vcr) and an air outlet valve (not shown). The air outlet valve allows for internal pressure regulation of the child device (101) by expulsion of substantially air upon filling of the child reservoir (103) with liquid. The child device (101) has a first portion (105) having a dispensing mechanism (107) preferably a spray pump and atomizer attached to the child device and a second portion (106) having a child refill mechanism (108), a liquid inlet (110) and a one way liquid inlet refill valve (111) associated therewith. The child dispensing mechanism may be provided with a protective cap (114).

The child reservoir (103) is in liquid communication with a liquid outlet of the child dispensing mechanism (107) such as a spray pump and preferably cap or an opening sealed with a stopper such as is typical with a flacon. The child device (101) may comprise a child pump mechanism for pumping liquid from the child reservoir to the liquid outlet. A nozzle may be provided just upstream of the liquid outlet for atomizing the liquid. The nozzle and child pump mechanism may be provided in a wide variety of configurations as known in the art, including the pump mechanism described herein for the parent pump. In certain embodiments, the air inlet valve may be located within the child pump, if present.

The child reservoir (103) stores a liquid such as a fragrance composition that may have been transferred from the parent reservoir (203). In some embodiments, the child reservoir has a liquid capacity of between about 1 ml and about 20 ml, or between about 3 ml and about 10 ml, or between about 5 ml and about 8 ml. The child device has a second portion (106) having a child refill mechanism (108), a liquid inlet (110) and a one way liquid inlet refill valve (111) associated therewith. The one-way liquid inlet refill valve (111) is provided to regulate liquid flow into the child reservoir (103) from the parent device (201).

The child liquid inlet (110) and one-way liquid inlet valve (111) is in liquid communication with the child reservoir (103). In one embodiment the child one way liquid inlet valve is in liquid communication with the child reservoir and a child inlet tube that extends downwardly from a bottom surface of the child reservoir (not shown). The child inlet tube is configured so that it may be slidably received within the liquid outlet of the parent device when the child device is releasably coupled to the parent device via the respective child and parent refill mechanisms. A downwardly depending skirt may encircle the child inlet tube.

Alternatively, the liquid outlet of the parent pump is in liquid communication with a parent discharge tube which can be inserted into the child inlet valve.

The child and parent devices each have a corresponding refill mechanism (108 & 208) to enable releasable coupling of the child refill mechanism to the parent refill mechanism. As used herein the term coupling means that the child and parent devices are at least partially co-joined preferably in a co-linear configuration to enable refilling. Suitable mechanisms include lock and key type systems, screw thread, bayonet, elastomeric fitments, captive plug mechanisms, push fit and magnetic fitments as known and described in the art.

In one embodiment, the parent body preferably the first portion thereof is provided with a cavity (215) to guide the coupling of the child to parent device. The internal dimensions of such a cavity are such as to at least accommodate a portion of the child device, preferably, the at least second portion of the child device, whilst still ensuring that the user can readily access the child device to enable placement and retrieval from the parent device. This enables easy alignment of the child and parent refill mechanisms by the user. The cavity may further be provided with a geometry which provides a 'lead in' to guide the placement of the child to the parent device.

Upon single actuation of the parent pump, preferably a vertical down stroke via the child device, a seal is formed around the liquid pathway from the parent outlet and the child inlet. The seal may be formed by any known mechanism. For example as described hereinabove, the parent outlet discharge/tube is pushed into the child outlet valve or the child inlet tube is pushed into the parent outlet. Alternatively, a portion of the surface adjacent the child inlet and parent outlet may be provided with a material such as silicone or rubber for example which will form a seal upon the application of pressure as the pump is actuated and thereby connect the child inlet and parent outlet respectively.

In one embodiment, the parent has an outlet discharge tube extending from the liquid outlet which can be inserted into the one way liquid inlet valve of the child or close proximity thereto such that the child liquid inlet valve is opened by the mechanical action of the parent outlet tube or due to the application of liquid pressure as a consequence of the actuation of the parent pump mechanism as described in U.S. Pat. No. 5,524,680.

After the child and parent refill mechanisms have been coupled together, the parent pump may be actuated in order to transfer the liquid from the parent pump to the child reservoir. Upon actuation of the parent pump which is typically achieved by a exerting a substantially vertical downward force upon the child device which is transferred to the parent pump, a seal is formed around a liquid pathway from the parent liquid outlet and the one way liquid inlet refill valve of the child reservoir. Liquid from the parent pump is then transferred via the liquid pathway to the child reservoir whilst the corresponding volume of air in the child reservoir is expelled via the child air outlet valve. Upon release of the downward force (end of the stroke) and completion of actuation of the parent pump, the seal and the liquid pathway are disconnected. The child may then be decoupled or disconnected from the parent device. The parent pump is refilled (primed for next refilling action) with liquid from the parent reservoir via the parent one way liquid inlet valve and air enters the parent reservoir via the air inlet valve. The actuator is then reattached to the patent device. The cap of the parent, if present, may then be replaced. Alternatively, the actuator is reattached to the parent upon replacement of the cap containing a parent actuator detachment means, thereby releasing the actuator from the cap.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid refill system for use with a fragrance composition, said liquid refill system comprising:

a child device having a child liquid reservoir having a volume (Vcr) and a child air outlet valve, said child device having a first portion having a child dispensing mechanism and a second portion having a child refill mechanism comprising a child liquid inlet and a child one way liquid inlet refill valve associated therewith;

a parent device having a parent liquid reservoir containing a liquid, said parent device having a first portion having a parent refill mechanism and a parent liquid outlet, said parent device having a parent inlet and a parent one way liquid inlet valve associated therewith, said parent device having a parent pump and a parent actuator releasably attached to said parent device, wherein said parent pump has a pump volume (VPP), in liquid communication with the parent liquid reservoir via the parent one way liquid inlet valve and in liquid communication with said parent liquid outlet, wherein the ratio of the pump volume of the parent pump (Vpp) to the volume of the child liquid reservoir (Vcr) is 12:1 or less; and said parent actuator having an actuator stroke limitation means, whereby a maximum volume (Vpa) of liquid dispensed upon actuation of the parent actuator is predetermined and less than said pump volume (Vpp); and a protective cap, said protective cap having a parent actuator detachment means, whereby the parent actuator is detached from the parent device and releasably connected to the protective cap upon removal of the protective cap from the parent device and upon replacement of the protective cap and parent actuator on the parent device, the parent actuator is released from the protective cap and re-attached to the parent device, wherein said liquid is after shave, skin care moisturizer or UV skin care liquid.

2. The liquid refill system according to claim 1, wherein said parent actuator detachment means is selected from a screw thread, lock and key system, rib lock, push closure and bayonet whereby said parent actuator is releasably attached to said protective cap.

3. The liquid refill system according to claim 1, wherein said protective cap comprises a two component cap comprising an upper cap portion releasably attached to a lower cap portion, said lower cap portion comprising said parent actuator detachment means.

4. The liquid refill system according to claim 1, wherein said parent actuator detachment means comprises a cap component and an actuator component, said components engaging with one another to releasably attach said cap to said actuator.

5. The liquid refill system according to claim 1, wherein said parent actuator is detached from said parent device upon rotation of said protective cap by at least 45° about the actuator central axis.

6. The liquid refill system according to claim 1, wherein the ratio of the pump volume of said parent pump (Vpp) to said child liquid reservoir (Vcr) is 10:1 or less.

7. The liquid refill system according to claim 1, wherein the ratio of the pump volume of said parent pump (Vpp) to said child liquid reservoir (Vcr) is substantially 1:1.

8. The liquid refill system according to claim 1, wherein the maximum volume (Vpa) of liquid dispensed upon actuation of said actuator is from 5% to 80% of said pump volume (Vpp).

9. The liquid refill system according to claim 1, wherein the maximum volume (Vpa) of liquid dispensed upon actuation of the said actuator to said pump volume (Vpp) is from 1:20 to 4:5.

10. The liquid refill system according to claim 1, wherein said child dispensing mechanism is a spray pump.

11. The liquid refill system according to claim 1, wherein said parent device comprises a cavity to accommodate at least a portion of said child device.

12. The liquid refill system according to claim 1, wherein the parent liquid reservoir has a liquid capacity of 100 ml or less.

13. The liquid refill system according to claim 1, the maximum volume (Vpa) of liquid dispensed upon actuation of the parent actuator is 0.2 ml or less.

14. A method of refilling the liquid refill system according to claim 1, the method comprising:

i) releasably detaching said actuator from said parent device and releasably coupling the child refill mechanism to the parent refill mechanism, and actuating the parent pump at least once to form a seal around a liquid pathway which extends from the parent liquid outlet to the child liquid inlet and the child one way liquid inlet refill valve of the child liquid reservoir, through which the liquid contained in the parent pump is transferred to the child liquid reservoir whilst air is expelled from the child liquid reservoir via the child air outlet valve, and upon termination of the actuation of the parent pump, the seal and the liquid pathway are disconnected, and the parent pump refills with liquid from the parent reservoir via the parent one way liquid inlet valve and parent inlet, and air enters the parent liquid reservoir via a parent air inlet valve of the parent liquid reservoir; and ii) decoupling the child refill mechanism from the parent refill mechanism.

15. The method of refilling according to claim 14, further comprising activating said parent actuator detachment means in order to attach said protective cap to said parent actuator and removing said protective cap and said actuator from said parent device.

16. The method of refilling according to claim 14, wherein the parent pump is activated at least twice.

17. The method of refilling according to claim 14, wherein said parent actuator is reattached to said parent pump.

18. The liquid refill system according to claim 1, wherein the parent device further comprises a parent air inlet valve.

19. A liquid refill system for use with a fragrance composition, said liquid refill system comprising:

a child device having a child liquid reservoir having a volume (Vcr) and a child air outlet valve, said child device having a first portion having a child dispensing mechanism and a second portion having a child refill mechanism comprising a child liquid inlet and a child one way liquid inlet refill valve associated therewith;

a parent device having a parent liquid reservoir containing a liquid, said parent device having a first portion having a parent refill mechanism and a parent liquid outlet, said parent device having a parent inlet and a parent one way liquid inlet valve associated therewith, said parent device having a parent pump and a parent actuator releasably attached to said parent device, wherein said parent pump has a pump volume (VPP), in liquid communication with the parent liquid reservoir via the parent one way liquid inlet valve and in liquid communication with said parent liquid outlet, wherein the ratio of the pump volume of the parent pump (Vpp) to the volume of the child liquid reservoir (Vcr) is 12:1 or less; and said parent actuator having an actuator stroke limitation means, whereby a maximum volume (Vpa) of liquid dispensed upon actuation of the parent actuator is predetermined and less than said pump volume (Vpp); and wherein said parent device further comprises a parent liquid return valve and parent return valve outlet, wherein said liquid is after shave, skin care moisturizer or UV skin care liquid.

20. A method of refilling the liquid refill system according to claim 1, the method comprising:

i) providing a liquid refill system for use with a fragrance composition, said liquid refill system comprising:

a child device having a child liquid reservoir having a volume (Vcr) and a child air outlet valve, said child device having a first portion having a child dispensing mechanism and a second portion having a child refill mechanism comprising a child liquid inlet and a child one way liquid inlet refill valve associated therewith, and a parent device having a parent liquid reservoir containing a liquid, said parent device having a first portion having a parent refill mechanism and a parent liquid outlet, said parent device having a parent inlet and a parent one way liquid inlet valve associated therewith, said parent device having a parent pump and a parent actuator releasably attached to said parent device, wherein said parent pump has a pump volume (Vpp), in liquid communication with the parent liquid reservoir via the parent one way liquid inlet valve and in liquid communication with said parent liquid outlet, wherein the ratio of the pump volume of the parent pump (Vpp) to the volume of the child liquid reservoir (Vcr) is 12:1 or less; and said parent actuator having an actuator stroke limitation means, whereby a maximum volume (Vpa) of liquid dispensed upon actuation of the parent actuator is predetermined and less than said pump volume (Vpp);

ii) releasably detaching said actuator from said parent device and releasably coupling the child refill mechanism to the parent refill mechanism, and actuating the parent pump at least once to form a seal around a liquid pathway which extends from the parent liquid outlet to the child liquid inlet and the child one way liquid inlet refill valve of the child liquid reservoir, through which the liquid contained in the parent pump is transferred to the child liquid reservoir whilst air is expelled from the child liquid reservoir via the child air outlet valve, and upon termination of the actuation of the parent pump, the seal and the liquid pathway are disconnected, and the parent pump refills with liquid from the parent reservoir via the parent one way liquid inlet valve and parent inlet, and air enters the parent liquid reservoir via a parent air inlet valve of the parent liquid reservoir;

iii) decoupling the child refill mechanism from the parent refill mechanism; and iv) activating said parent actuator detachment means in order to attach said protective cap to said parent actuator and removing said protective cap and said actuator from said parent device.

* * * * *